United States Patent [19]

Klepeis

[11] Patent Number: 5,073,033

[45] Date of Patent: Dec. 17, 1991

[54] LIQUID MIXER

[76] Inventor: Stanley J. Klepeis, 11 High Acres Dr., Poughkeepsie, N.Y. 12603

[21] Appl. No.: 436,656

[22] Filed: Nov. 15, 1989

[51] Int. Cl.[5] ..... B01F 7/16

[52] U.S. Cl. ..... 366/328; 366/330; 366/605; 416/231 R; 416/237

[58] Field of Search ..... 366/129, 243–245, 366/247, 248, 265, 270, 328–330, 605, 343, 246; 416/227 R, 227 A, 231 R, 231 A, 231 B, 235, 237, 237 A, 237 B

[56] References Cited

U.S. PATENT DOCUMENTS

| | | | |
|---|---|---|---|
| 941,948 | 11/1909 | Rees | 366/328 X |
| 948,004 | 2/1910 | Brown | 366/328 |
| 973,554 | 10/1910 | Pearson | 366/243 X |
| 1,271,581 | 7/1918 | Keith | 416/237 X |
| 2,235,604 | 3/1941 | Brumagim | 366/329 |
| 2,799,485 | 7/1957 | Silverman | 366/329 X |
| 2,896,925 | 7/1959 | Place | 366/605 X |
| 2,918,264 | 12/1959 | Ackles | 366/605 X |
| 3,166,303 | 1/1965 | Chapman | 366/129 |
| 3,333,831 | 8/1967 | Chapman | 366/129 |
| 3,580,550 | 5/1971 | Hunnicutt | 366/605 X |
| 3,733,645 | 5/1973 | Seiler | 366/129 |
| 4,054,272 | 10/1977 | Cooke . | |
| 4,083,653 | 4/1978 | Stiffler | 366/329 X |
| 4,175,875 | 11/1979 | Van Horbeck | 366/605 X |
| 4,176,797 | 12/1979 | Kemp . | |
| 4,260,267 | 4/1981 | Walton | 366/129 X |
| 4,339,992 | 7/1982 | Kurland . | |

*Primary Examiner*—Harvey C. Hornsby
*Assistant Examiner*—C. Cooley
*Attorney, Agent, or Firm*—Schmeiser, Morelle & Watts

[57] ABSTRACT

A mixer incorporating a shaft having one end which is adapted to be received into the chuck of a drill and the other end which includes a specially shaped mixing blade. The blade includes triangular end portions that are both angled up relative to the general plane of the blade. Rotation of the blade in one direction causes fluid to be pushed down and to the side. Reversing the blade direction causes the fluid to be pushed upward and to the side.

6 Claims, 1 Drawing Sheet

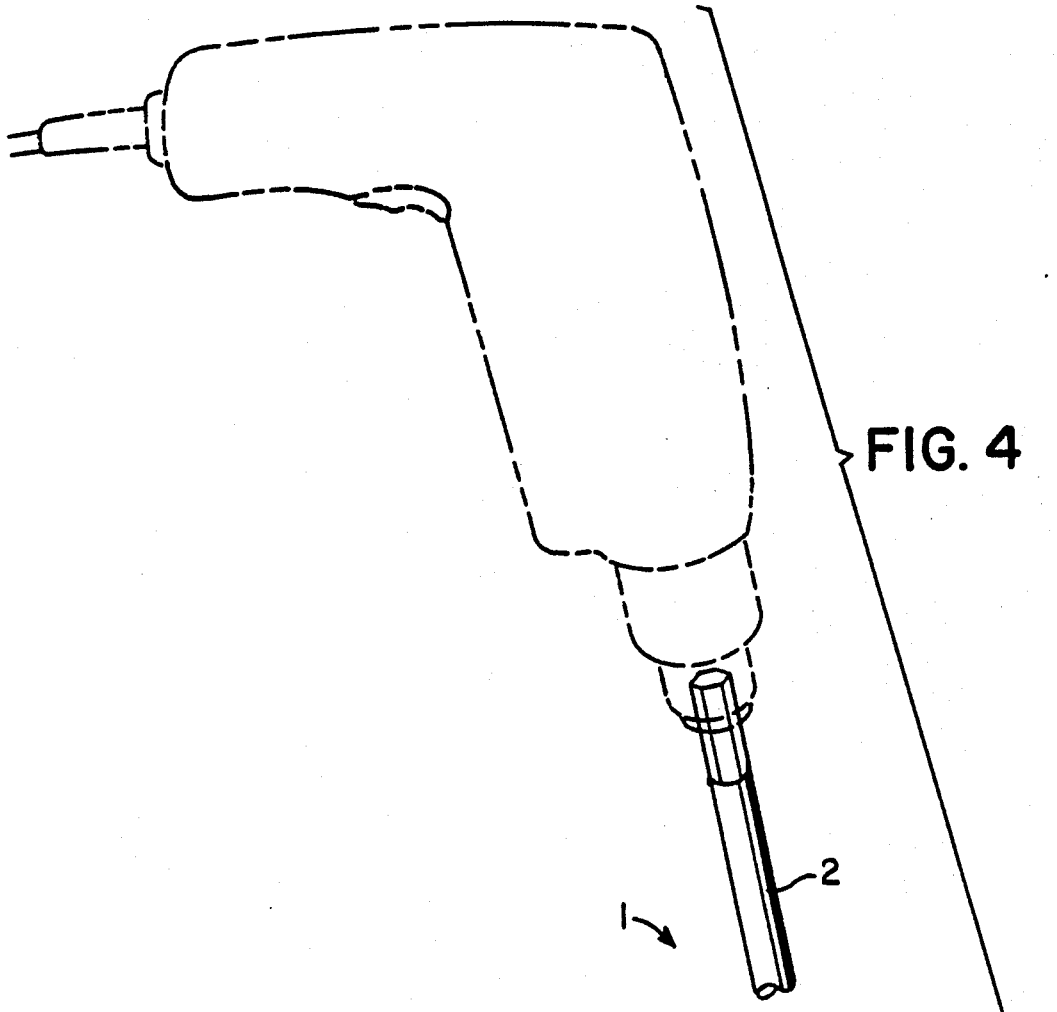
FIG. 4
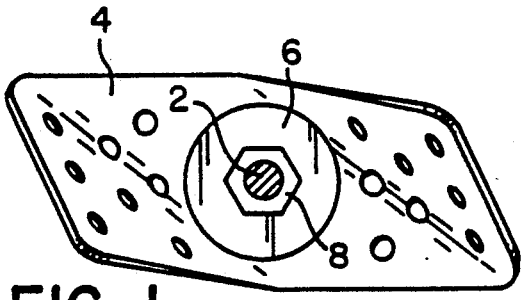
FIG. 1
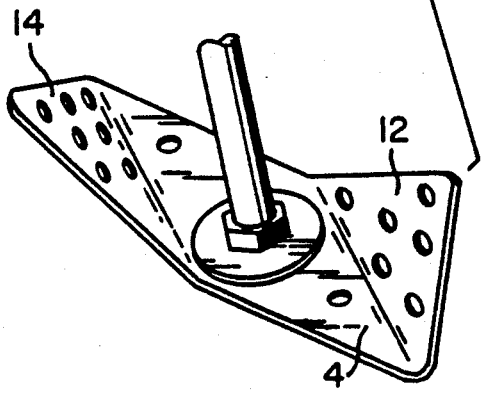
FIG. 2
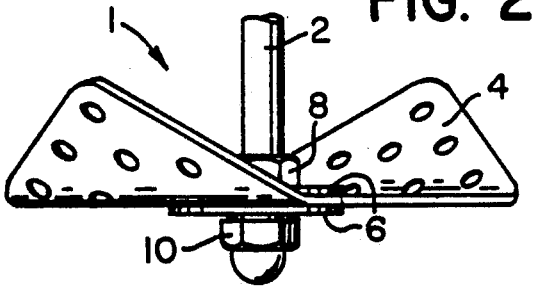
FIG. 3
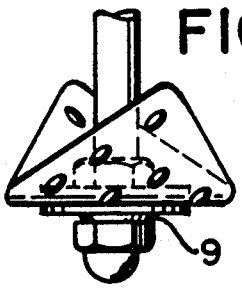

LIQUID MIXER

FIELD OF THE INVENTION

This invention is in the field of liquid stirrers and mixers. More particularly, the instant invention is a device that can be powered by a drill and used to mix highly viscous liquids.

BACKGROUND

Many liquids require mixing prior to use. The most basic mixing procedure is to place a long rectangular paddle within the container of liquid and move the paddle in a circular manner. Depending on the type of liquid, this can be a time-consuming, tiring and messy process. Alternate methods include the use of paint shakers in which a can of paint is mounted on a reciprocating platform and a motor "shakes" the can until mixing is complete. This method, while efficient, requires a machine Which is too expensive for the casual user to purchase. Other types of mixing apparatus have been patented which attempt to facilitate mixing of liquids.

Kurland (U.S. Pat. No. 4,339,992) invented a mixing machine that is designed to hang from the top of a pan or container. The mixer includes replaceable paddles that have slots to allow some passage of the liquid. The paddles are designed to extend from near the liquid surface to proximate the bottom inner surface of the pan or container. A permanently affixed motor or similar rotating means provides the driving force to turn the paddles.

Kemp (U.S. Pat. No. 4,176,797) teaches the use of a shaft mounted mixer that can be inserted into a drill chuck. The mixer includes at least two discs that can be rapidly rotated to effect the mixing operation. In this invention, at least one disc is fixed to the shaft and the other can freely spin about the shaft. One of the discs is perforated and fluid is drawn between the two discs.

Cooke (U.S. Pat. No. 4,339,992) shows a multi-bladed mixing device also attachable to a drill. In this device, a pair or angled blades are fixedly attached to a central shaft. The ends of each of the blades are twisted in opposite directions. This causes the fluid Within the container to circulate from the bottom to the top of the container.

SUMMARY OF THE INVENTION

The instant invention is a mixer that can be used to mix highly viscous liquids such as tars, resins and thick paints. Basically, the invention is a specially shaped blade that is mounted on a shaft sized to fit into the chuck of a standard power drill. The blade has end portions comprising opposite diagonal corners which are both angled upward (toward the end of the shaft Which Would be received into the drill) at approximately 45 degrees. The blade end portions are foraminous i.e. they include through-holes or perforations that allow passage through the blade of some of the liquid to be mixed. It is envisioned that bigger holes could be used for thicker, more viscous fluids such as tar and smaller holes could be used for less viscous, thinner watery fluids.

The blade is basically a thin, perforated rectangular strip in which a pair of opposite diagonal corners are bent upwardly at approximately the same angle. The bent corners are in the shape of triangles with their bases forming creases in the strip that are essentially parallel to each other. The center of the strip has a hole through which the shaft passes. A large number of different fastening methods can be used to attach the blade to the shaft and would be obvious to one of ordinary skill in the art. For example, the bottom of the shaft can be threaded and a pair of nuts and washers ca fasten the blade between them. Alternatively, the blade can be welded to the shaft or be an integral, unitary portion of the shaft (i.e. the shaft and blade could be molded as a single piece). The shaft and blade can be made of any number of materials including plastic, metal or combinations thereof.

The design of the mixer affords numerous advantages. The through-boles allow the mixer to be used in highly viscous liquids without bogging down or causing the liquid to splash from the container. The holes also act to comminute or break-up clumps of material suspended in the liquid. The specific upward angling of the blade end portions is responsible for the ability to change the manner of mixing depending on the direction of rotation. A first direction of rotation would tend to push the liquid down and toward the sides of the container. For this direction of rotation, the mixer can be turning prior to immersion into the liquid. As the blade contacts the surface of the liquid, the liquid is directed in a somewhat downward direction thereby preventing splashing of the user with liquid. If the blade is submerged only a short distance into the liquid (for example, a paint can with a 12 inches depth of liquid and the blade of the stirrer one inch below the surface of the liquid), at first only the top portion of the liquid will be affected. In this way, the user could mix the upper liquid layers without disturbing unwanted sediment in the bottom of the container (e.g. dirt or paint chips). To accomplish this in the most effective manner, the blade could be inserted only a short distance into the liquid and the mixer could be operated in pulses, thereby only mixing the top layers of the liquid. Letting the mixer run would, in time, effect complete mixing within the container. In this way, even liquids in a deep container could be effectively mixed with the mixer blade located only a short distance from the liquid surface.

The angling of the blade is also effective when the blade is rotated in a second or opposite direction. The blade can be positioned proximate the bottom of a container prior to activation of the shaft turning mechanism. As soon as the blade starts turning in the second direction, the liquid is pushed upwardly and to the sides of the container. In this way, the liquid in the bottom of the container is first mixed and continued rotation of the blade eventually mixes all of the fluid within the container. If there is a sediment that the user wishes to mix as soon as possible into the liquid, positioning the blade as described will effectively suck the sediment upwardly and thereby accomplish the mixing operation.

In another preferred method of operation, the blade can be positioned proximate the middle of the volume of liquid. A bi-directional drill can be attached to the shaft and the blade can be rotated first in one direction then in the other. This cycling effect causes the liquid to circulate first in one direction then in the other. This oscillating effect rapidly and effectively mixes the liquid in a manner unlike the prior art.

BRIEF DESCRIPTION OF THE DRAWINGS

FIG. 1 is a plan view of the invention.

FIG. 2 is an elevation view of the bottom portion of the invention.

FIG. 3 is a view similar to that of FIG. 2 except that the blade has been rotated 90 degrees.

FIG. 4 is an isometric view of the invention.

DESCRIPTION OF THE PREFERRED EMBODIMENT

The mixer 1 comprises a shaft 2 and a blade 4. In the preferred embodiment, the shaft fits through a hole (not shown) in the center of the blade. The end of the shaft is threaded and the blade is sandwiched between a pair of washers 6 and an upper nut 8 and a lockwasher 9 above bottom cap nut 10. This arrangement of fasteners securely attaches the blade to the shaft, As can also be seen, the blade is constructed from an originally rectangular perforated plate in which opposite diagonal end portions 12, 14 have been bent upwards. The incline of the blade end portions is preferentially 45 degrees relative to the plane formed by the center unbent portion of the blade. After bending and as seen in FIGS. 1 and 4, the unbent center portion of the blade would be rhomboid in shape.

Depending on the material to be mixed, it is envisioned that the blade end portions can be bent to angles other than 45 degrees. If one wishes to increase the mixing effect in a direction parallel to the shaft, the blades can be bent at less than a 45 degree angle. This would be most useful if one wanted to focus the mixing effect to break up particles or to increase the mixing force on a sediment at the bottom of a container.

Bending the blade end portions at greater than 45 degrees would localize the mixing effect to certain layers of contained liquid. In this way, one could mix the top layer or layers of a liquid without disturbing an unwanted sediment located in a bottom layer of the container.

in operation, the shaft 2 of the mixer is connected to the chuck of a power or hand drill. Depending on the viscosity of the liquid, the mixer is then either placed above the liquid, fully submerged in the liquid (for a low viscosity liquid) or partially submerged (for a thick liquid such as roofing tar). The drill is then started and the mixer starts turning. At this point, the mixer can be submerged in the liquid or be moved up and down in the liquid to stir up different layers. Once in the liquid, the rotation of the mixer can be continually changed to oscillate the movement and attendant circulation of the liquid within the container. The use of a perforated or foraminous blade allows a portion of the liquid to pass through the blade and thereby allows the blade to rotate in even highly viscous liquids. In a preferred embodiment, the perforations or foramens are between one-sixteenth and one-quarter inch in diameter and there are approximately 2 perforations per square inch of blade area.

It is envisioned that the shaft can be of any length with typical commercial applications using a shaft length between 6 and 36 inches. The blade can have an end to end length of between 3 and 36 inches.

The shaft is sized to fit within a standard ½ inch drill chuck. For mixing the contents of a 1 gallon or 5 gallon paint can, the shaft used would typically have a length between 6 and 18 inches and the blade would have an end to end longitudinal length of 3 to 6 inches and a width of approximately 2 to 3 inches.

The embodiment disclosed herein has been discussed for the purpose of familiarizing the reader with the novel aspects of the invention. Although a preferred embodiment of the invention has been shown and described, many changes modifications and substitutions may be made by one having ordinary skill in the art without necessarily departing from the spirit and scope of the invention.

I claim:

1. A mixing attachment that is adapted to connect to a turning means that functions to rotate said attachment, said mixing attachment comprising:

a shaft having a bottom end and a top end wherein said top end defines an upper portion of said attachment and includes a connecting means for connecting to a complementary connecting means located in said turning means;

a blade mounted to said shaft proximate its bottom end, said blade having two opposite diagonal corners and a flat central portion located between said corners wherein said two corners are inclined upward relative to a plane formed by said central portion of said blade and said blade having a plurality of through-holes in said inclined corners whereby when the attachment is being used to mix a container's contents, portions of said contents can pass through said through-holes in the blade; and wherein said central portion of said blade has a rhombold shape and each of said inclined corners has a triangular shape.

2. The attachment of claim 1 wherein the upward inclination of the inclined corners is approximately 45 degrees.

3. The attachment of claim 1 wherein the top end of said shaft is sized to fit into a standard ½ inch drill chuck.

4. The attachment of claim 1 wherein said blade is fashioned from a rectangularly shaped material.

5. The attachment of claim 1 wherein said shaft has a length between 6 and 18 inches and said blade has a length between 3 and 6 inches.

6. The attachment of claim 1 wherein said through-holes have a diameter of between one-sixteenth and one-quarter inch and are located in a manner wherein there are approximately two through-holes per square inch of blade area.

* * * * *